United States Patent [19]

Boie et al.

[11] 4,399,212

[45] Aug. 16, 1983

[54] METHOD OF PROCESSING AN EXPOSED PHOTOGRAPHIC MATERIAL AND PROCESSING BAND FOR CARRYING OUT THE METHOD

[75] Inventors: Immo Boie, Langenfeld; Hermann Lührig, Leverkusen; Guido Kovačić, Unkel; Karlheinz Keller, Bergisch Gladbach, all of Fed. Rep. of Germany

[73] Assignee: AGFA-Gevaert Aktiengesellschaft, Bayerwerk, Fed. Rep. of Germany

[21] Appl. No.: 353,197

[22] Filed: Mar. 1, 1982

[30] Foreign Application Priority Data

Mar. 6, 1981 [DE] Fed. Rep. of Germany ..... 3108534

[51] Int. Cl.[3] ..... G03C 5/30; B65D 85/66; G03D 5/00

[52] U.S. Cl. ..... 430/404; 430/206; 430/421; 134/64 P; 206/390; 354/318

[58] Field of Search ..... 430/206, 404, 418, 421; 134/64 P; 354/318; 206/390

[56] References Cited

U.S. PATENT DOCUMENTS

| | | | |
|---|---|---|---|
| 1,441,163 | 1/1923 | Martin et al. | 134/64 P |
| 2,906,399 | 9/1959 | Lysle et al. . | |
| 2,920,960 | 1/1960 | Bushell | 430/401 |
| 3,413,181 | 11/1968 | Goldhammer et al. | 430/501 |
| 3,572,232 | 3/1971 | Cronig | 430/434 |

FOREIGN PATENT DOCUMENTS

| | | | |
|---|---|---|---|
| 2444207 | 3/1975 | Fed. Rep. of Germany | 430/401 |

OTHER PUBLICATIONS

Bulletin R-P, "From Exposure to View in Less Than 60 Seconds," Rapromatic, Inc., 1960.

*Primary Examiner*—Mary F. Downey
*Attorney, Agent, or Firm*—Connolly & Hutz

[57] ABSTRACT

The present invention relates to a method and to a processing band for processing a sheet or strip of photographic material (1) which has been image exposed and is brought into surface contact, in the presence of water, with a carrier (2) which is impregnated with the required processing chemicals. The photographic material (1) which has been image exposed is repeatedly moved along a closed path and brought into surface contact with the processing band (2) along a specified portion of said path in the presence of water, the processing band (2) having at least wo sections with different processing functions (A, B, C . . . ) arranged one behind the other, with which every portion of the photographic material (1) comes successively into contact.

21 Claims, 9 Drawing Figures

Figure 1:
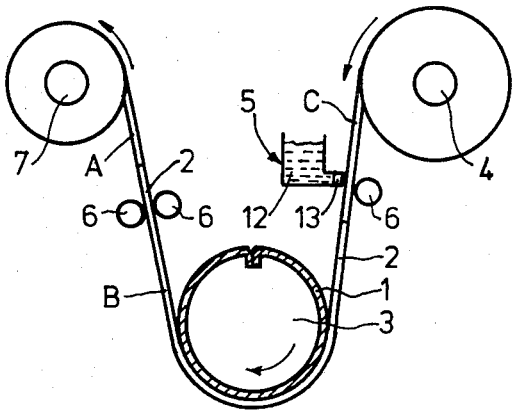

METHOD OF PROCESSING AN EXPOSED PHOTOGRAPHIC MATERIAL AND PROCESSING BAND FOR CARRYING OUT THE METHOD

The present invention relates to a method for processing a photographic material in the form of sheet or strip which has been image exposed, in which process the photographic material is brought into surface contact, in the presence of the required quantity of water, with a carrier which has been impregnated with the required processing chemicals, and to a processing band for carrying out the method.

The processing of photographic film or paper which has been image exposed normally requires numerous baths in which the processing chemicals are dissolved. The processing of a black-and-white film requires at least one developer bath, a fixing bath and a washing bath. Additional baths are required for the processing of colour films and paper.

The conventional use of baths has considerable disadvantages, particularly if only one or a small quantity of film strips or paper sheets are to be processed, as is frequently the case, for example, in amateur photography. The baths must then be individually prepared and adjusted to the correct temperature. The baths, once prepared, will frequently only keep for a limited time, as in the case of developer baths, so that if the baths are only used once there is a considerable wastage in material and money. The baths containing the chemicals are environmentally harmful if they are poured into the drains. Even slight fluctuations in the composition of the baths or diminishing concentrations in the chemicals when using the baths effect the results of processing unless the baths are continuously regenerated, which would require an elaborate procedure.

Other processing methods for photographic materials which have been image exposed make use of a bath or paste and auxiliary sheets with a complicated application of control layers. Processing in these cases requires expensive and sensitive squeezing roller devices for squeezing out and spreading out the paste or the activators. The number of process steps is limited and at least two sheets are required.

Sheets impregnated with processing chemicals have been disclosed in German Offenlegungsschrift No. 2 444 207. To process an exposed photographic material, the sheets are placed one after the other on the photographic material which is required to be processed, and they are moistened with water. During the processing period, the chemicals are dissolved out of the sheets and react with the layer of photographic material which has been image exposed.

The placing of each sheet separately on the photographic material to be processed is a complicated procedure and each moistened sheet has to be removed after each processing step as a dripping piece of waste material. The photographic material is washed after each step of the process. The method is only applicable to individual photographic sheets of film or paper. No processing sheets containing chemicals which could be used, for example, for neutralising polymeric acids, are provided.

A multilayered laminated special band for processing photographic materials has been disclosed in U.S. Pat. No. 3,572,232. This band consists of a supporting layer covered with an absorbent layer which is pregnated with processing chemicals and above this absorbent layer, a microporous layer through which the chemicals can reach the photographic material which is to be processed. This special band may also be used for relatively long photographic materials but otherwise has the same disadvantages as the sheets described above.

Other sheets are known which comprise a supporting band containing chemicals for both bleaching and fixing the photographic material previously developed in a developer. These sheets have been described in European patent application No. $A_1$-0 008 144. They statically carry out various processing stages but are limited to the special bleach fixing process so that their use cannot be expanded to further processing steps.

The sheets have a very complicated arrangement of layers. The viscous activator paste has to be squeezed out, and is therefore liable to contaminate surrounding areas. The bleaching sheet must be sep rated off and causes environmental problems. Salts are left behind in the residual image, and these are liable to cause trouble if storage is prolonged.

It is therefore an object of the present invention to provide a method of the type indicated above by which various photographic materials which have been image exposed can easily be processed with a minimum of chemicals without the need for preparing baths or using pastes and without causing any damage to the environment Based on a method of the type indicated above, this problem is solved according to the invention by the following means:

The photographic material which has been image exposed is repeatedly carried along a closed path having radii of curvature perpendicular to the active surface layer of the photographic material, along a specified portion of this closed path, the photographic material is brought into surface contact with a processing band in the presence of the required quantity of water, and the processing band comprises at least two sections arranged one behind the other in the longitudinal direction which have different processing functions or contain different processing chemicals so that every portion of the photographic material is brought into contact with at least two processing functions in succession in the course of being processed. It is surprising to the man in the art to find that such excellent processing results can be obtained by such a simple method and with only a small quantity of chemicals.

The photographic material which has been image exposed is placed on the closed path in the dark, for example, it may be stretched on a drum, and is brought into contact with a processing band which has been activated by water shortly before its encounter with the photographic material. For each processing step, such as development, fixing, washing and drying, for example, the processing band has a separate section containing the necessary chemicals or functions. These sections are brought into contact with the photographic material at least once so that each portion of the material is uniformly and sufficiently supplied with the chemicals. The processing band is normally only used once and then rolled up and destroyed so as to cause no environmental pollution; silver, for example, may be recovered by burning the band.

Since the sections containing the various processing functions may be arranged side by side in any desired sequence, a processing apparatus may be used to process any desired photographic material.

Baths or pastes, which are inconvenient for the amateur to use and require special equipment, are dispersed with. Once the photographic material has been inserted in a processing apparatus, processing may be carried out anywhere and with a minimum of technical procedure. There is no wet waste product and only as much chemicals as is required for processing is used.

For short photographic processes with only a small number of steps, it is advantageous to employ a method which is characterised in that the material which has been image exposed is moved at the same speed as the processing band, and the length of each section of the processing band is equal to or an integral multiple of the length of the closed path of the photographic material.

The processing band lies on the photographic material and accompanies it along part of its closed path so that the photographic material is always in contact with fresh chemicals or fresh areas of the processing band containing processing functions. When the photographic material has travelled through one or more paths, it enters into contact with a following section of the processing band, containing different functions, and so forth until finally the photographic material has passed through all the processing steps and may be removed almost dry from the apparatus.

In another advantageous method, the processing band is moved more slowly than the exposed photographic material and the length of each section of the processing band is chosen so that the treatment time is equal to or an integral multiple of the time taken for the photographic material to travel round in the closed path.

The method enables shorter lengths of processing band to be used; this is advantageous if, for example, relatively long strips of photographic material are required or a large number of processing steps are to be carried out. In such cases, the chemicals are more densely packed in the processing band and the band undergoes displacement relative to the photographic material. It has surprisingly been found that no damage is done if the processing band slips, even in contact with highly sensitive film surfaces, since slipping takes place on a film of water between the layers.

Even shorter lengths of processing band may be used in a method which is distinguished by the fact that the processing band is displaced intermittently and a section of the band remains in contact with the material which has been image exposed until this material has passed through a closed path or an integral multiple thereof.

In this method, the processing band is substantially shorter than the photographic material and it is more densely packed with chemicals or processing functions. Each section of the processing band is brought into contact, over a segment of an arc, with the photographic material which is moved in a closed path, and the section remains in this position until the photographic material has moved at least once through the path, and it is then moved on so that the next section is brought into contact with the photographic material. The relative displacement between the processing band and the photographic material produces a turbulent flow in the film of water, whereby the action of the chemicals is accelerated and reinforced. No damage to the photographic material has been detected when this method has been used.

The individual sections of the processing band contain the required chemicals for processing the photographic material which has been image exposed. Thus at least one section of the band contains chemicals for the development of silver halides which have been image exposed. For processing colour materials, at leat one section contains a colour developer substance. Another section contains a silver bleach and yet another a fixative (silver halide solvent).

For each possible processing step, such as, for example, development, lith development, colour development, short stopping with short stop chemicals, colour bleaching, silver bleaching, bleach fixing, fixing, stabilization, neutralisation, etc., at least one section is provided on the processing band. If the fixing process, for example, takes twice as long as the development process, then two sections may be provided for fixing or the speed of the processing band relative to the photographic material may be appropriately reduced or increased.

Any photographic materials may be processed by the method, provided the chemicals can be accommodating on a processing band. Without giving a complete list, suitable processes include the processing of black-and-white original photographic material, black-and-white copying material, black-and-white reversal material, direct positive material, chromogenic colour photographic material, silver-dye bleaching material, material for graphic reproduction (lith films), colour materials operating on the retained image principle, and others.

The method may be carried out in an advantageous and simple manner by stretching at least one turn of the photographic material which has been image exposed over a drum which is adapted to be driven and placing the processing band with its various sections over part of the circumference of the drum and in contact with the photographic material.

In this arrangement, the processing band may easily be carried along by the driven drum and be moistened by a sponge or applicator roller to activate the chemicals before it is brought into contact with the photographic material. The device for moistening is designed to be swung out of position so that some sections may be kept free from aqueous liquid.

Another equally advantageous method is distinguished by the fact that the photographic material which has been image exposed is passed in the form of an endless loop over at least two drums, the various sections of the processing band are placed over at least one drum to be brought into contact with the photographic material, and the photographic material is carried through a liquid, for example water, in its passage over at least one drum.

This arrangement requires no separate moistening device for the processing band since the photographic material itself is moistened and brings the aqueous liquid to the chemicals on the support band. One advantage is that the action of chemicals is in each case followed by washing. For processing steps which require no water, the container may be lowered or the photographic material may be raised with the processing band.

In one advantageous embodiment of the method, the processing band delivered from a take-off device is moved past a moistening device and over the zone of contact with the exposed photographic material to a take-up or winding device.

The processing band may be supplied in the form of a roll to be mounted on a take-off device and carried from there to a winding roller. The processing band may also be inserted in processing cassettes provided with means for winding and unwinding.

For short photographic processes, the processing band comprising at least two sections may be moved along a closed path while the exposed photographic material is moved along a closed path on a drum or in a loop so that the whole surface of the photographic material makes contact with a section of the processing band.

One advantage of this particular method is that if the processing band carries a sufficient quantity of chemicals, it may be used several times for the development of a photographic material before it has to be replaced by a fresh band.

The processing band used for the method is distinguished by the fact that in addition to the at least two sections containing different processing chemicals, it has other sections with processing function arranged or inserted before, behind or between the sections containing the processing chemicals.

It is advantageous to provide leader tapes at the beginning and end of the processing band in order to facilitate introduction or threading of the band into an apparatus.

It is also advantageous to provide sections in the processing band which have the characteristic of moistening the photographic material with an aqueous liquid before the photographic material is exposed to the action of the chemicals.

In that case, the processing band includes a section which absorbs liquid and gives it up to the photographic material.

Such absorbent materials include absorbent paper such as blotting or filter paper, non-woven webs of fibres or synthetic materials, thin foams, artificial leather or support materials carrying an absorbent layer which is capable of swelling, such as a layer of gelatine, polyvinyl alcohol, methyl cellulose or polyvinyl pyrrolidone.

These materials are also suitable for use as sections in the processing band which absorb the processing chemicals and neutralise or bind them when the dry absorbent material comes into contact with the photographic material.

These sections may also be used to dry the photographic material at the end of the photographic process by absorbing the liquid as far as possible and removing it. The tape at the end of the processing band may also be equipped with absorbent material for this purpose.

The bands carrying chemicals are prepared by impregnation, coating or application of the chemicals on the above described liquid absorbent materials over the whole width of the web of material. The treated webs are then dried and cut up into strips corresponding to the aforesaid sections. The cut sections are joined together in the required sequence to form a processing band, for example, by glueing or welding the sections together or sewing or stapling them together.

Short processing bands are produced by coating a wide web of material simultaneously with strips of different chemicals in the longitudinal direction and drying the web. The web is then cut out transversely to form processing bands in which sections of different processing chemicals are arranged one behind the other. One inexpensive form of processing band consists of a simple material which is protected against moisture and enrivonmental influence by a moistureproof packing before it is ready to be processed.

One advantageous processing band is distinguished by the fact that it consists of several layers, at least one of which layers is impregnated with processing chemicals or has a processing function while an upper and a lower layer cover the processing chemicals to protect them and one of these protective layers is capable of being dissolved by the aqueous liquid.

The sections of the processing band are mounted on a water-resistant support band and protected by a water-soluble foil. Foils of this type are known, for example, under the name of Mowiol foils (Hocchst) and will dissolve without leaving any residues liable to interfere with processing.

Another equally advantageous processing band is characterised in that it is fixed to a support layer and is provided with processing chemicals in the moist state, and the moist chemicals are enclosed within a moistureproof foil which is adapted to be stripped off inside the processing apparatus.

This processing band enables the photographically exposed material to be processed without any supply of liquid from outside.

A processing band which is suitable for chemicals which react with each other or are incompatible in the dry state comprises one section in which at least two separate layers containing different chemicals are arranged one above the other and do not react with each other until they come into contact with an aqueous liquid to fulfil their processing function.

Another embodiment of the processing band is distinguished by having at least one section in which the image area is cut out so that the photographic material can be washed in a water bath or the photographic process can be interrupted.

The method described above provides an astonishingly simple means of processing a wide variety of exposed photographic materials in the same apparatus with a minimum of processing chemicals, using the processing band according to the invention. It requires no baths or pastes or squeezing rollers. Processing is carried out with a minimum of environmental pollution since only a small quantity of aqueous liquid is required which contains little or no chemicals. The processing band can be easily be destroyed or burnt to recover the silver.

The simplicity of the method is particularly advantageous in enabling every amateur to process photographic materials wherever he wishes and with no difficulty or special equipment. With the known tank development processes, the amateur is required to fill the tank with processing liquid at every stage of the process, shake or turn the photographic material in the tank, empty the tank and monitor the processing time at each stage. Processing usually comprises four to ten stages which in addition to the processing time as such requires additional time for the various operations and considerable consumption of chemicals.

The work involved is even greater if the various processing liquids must be prepared before the process.

With the method using the processing band, on the other hand, once the material which has been image exposed and the processing band have been placed in position, all the steps of the process take place in succession an an optionally processed, almost dry photographic material of excellent quality is obtained without any difficulty.

Figure 2:
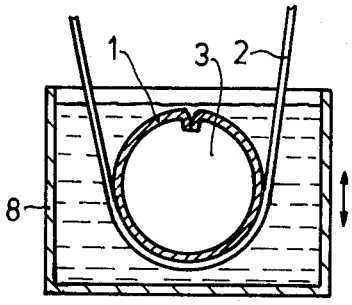
Figure 3:
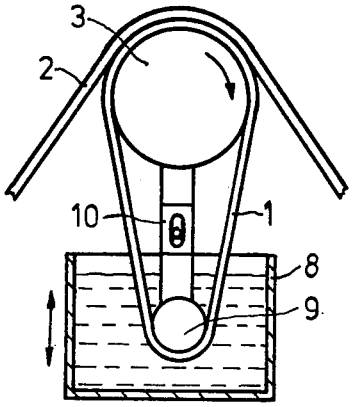
Figure 4:
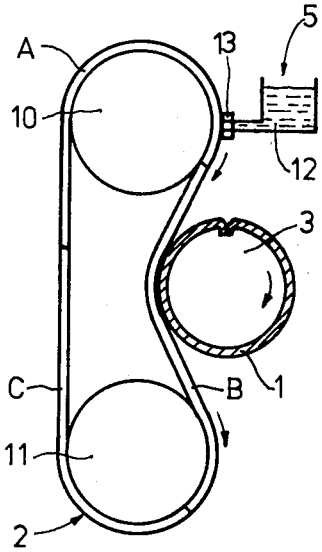
Figure 5:
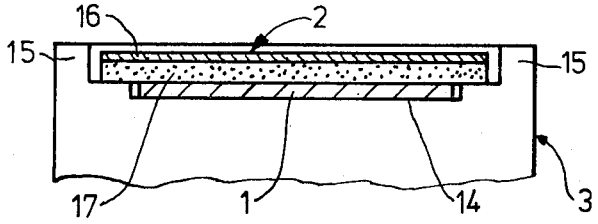
Figure 6:
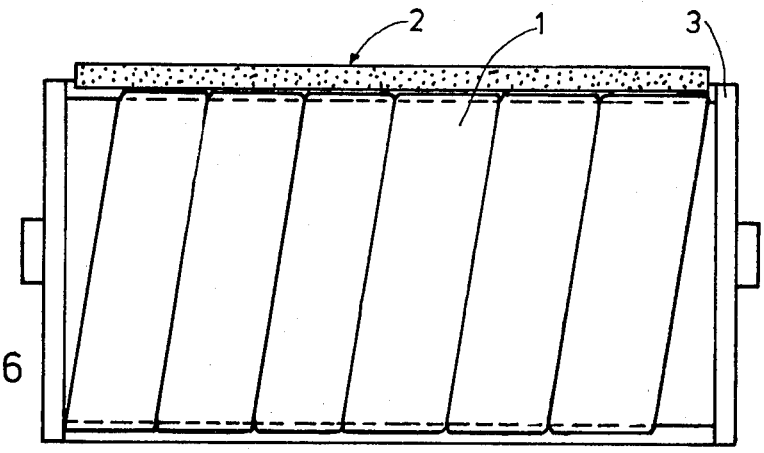
Figure 7:
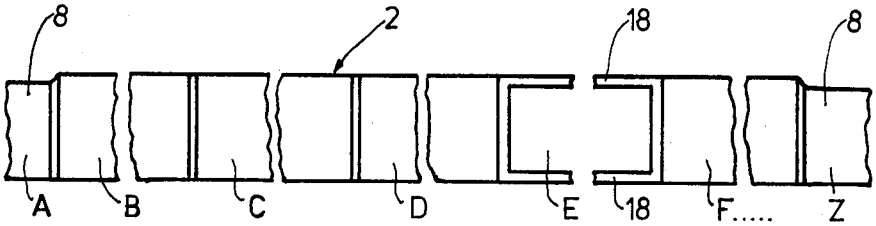
Figure 8:
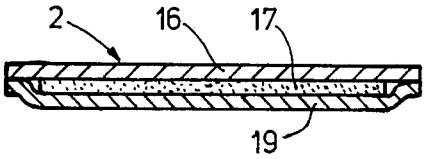
Figure 9:
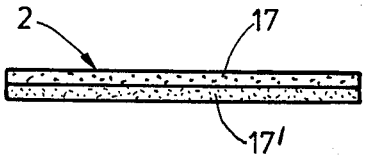

The invention is described in more detail below with reference to drawings, in which FIG. 1 illustrates a method of processing photographic materials which have been image exposed, using a moistened processing band, FIG. 2 illustrates a method of processing photographic materials using a processing band in an aqueous liquid, FIG. 3 illustrates a method of processing photographic materials using a processing band, in which the photographic material is moistened, FIG. 4 illustrates a method corresponding to that of FIG. 1 in which the processing band is arranged in a loop, FIG. 5 illustrates a processing band and a photographic material on a processing drum, FIG. 6 illustrates a processing roller and a processing band for relatively long strips of photographic material, FIG. 7 gives a shortened view of a processing band, FIG. 8 represents a section taken transversely to the direction of travel of a processing band, and FIG. 9 illustrates a multilayered processing band.

FIG. 1 illustrates schematically a method of processing a strip of photographic material 1 which has been image exposed, for example a black-and-white film strip or a colour photograph. The strip 1 is stretched over a drum 3. The processing band 2 is rolled off a take-off device 4 and moved past a moistening device 5 which is adapted to swing toward the processing band 2 to moisten it for wet processing steps or away from the band 2 for dry processing steps. The processing band 2 thereafter embraces a specified length of the drum 3 to make contact with the photographic material 1 which is to be processed. This specified length over which the band 2 is looped round the drum 3 may be kept constant by various means, such as guide rolls 6. When the processing band has been used, it is rewound to form a roll on the winding device 7. The processing band 2 comprises sections A, B, C, . . ., whose lengths in their direction of travel is equal to or a multiple of the circumference of the drum 3 so that the action of the chemicals can not only be influenced by their concentration on the processing band 2 but the length of their reaction time may also be varied by an integral multiple, for example, if certain processes require prolonged action of these chemicals. The processing band is then provided with two, three or more similar sections arranged one behind the other. In a simple apparatus for carrying out the method, the processing band 2 is driven by winding on device 7 either by a motor or by hand. The winding on device has a brake which keeps the band 2 taut so that the drum 3 is moved synchronously with it. The moistening device 5 is controlled by notches or recesses 8 in the processing band 2 (see FIG. 7). By using a winding on device 7 of not too small a diameter a virtually constant processing speed may be obtained throughout the photographic process. If very accurate processing speeds are required, the guide roll 6 may be combined with a driven roll 6' on the winding on side to drive processing band continuously. The winding on device is then driven by friction, for example by way of a friction, coupling or a belt.

A method such as that illustrated in FIG. 2 enables the photographic material 1 to be washed on the drum 3 in a container 8 after it has been subjected to the action of the chemicals on the processing band 2. For this purpose, the processing band 2 should be so designed that the chemicals are not dissolved in large quantities in the container containing water. The band is therefore provided with a water-impermeable support layer 16 on the side facing away from the drum 3 (FIG. 5) and in addition the band 2 may be provided on the side facing the drum with a water-soluble layer which dissolves when immersed in the water bath (see FIG. 8) and does not release the chemicals until it reaches the drum 3.

For processing steps which do not require water, the container 8 or the drum 3 is moved upwards or downwards (see double arrow). The processing band is again driven as in FIG. 1.

FIG. 3 illustrates a modified method in which the photographic material 1 absorbs the required liquid for wetting the processing band 2 from a container 8 and transfers the liquid to the band 2. This method can again be used fo either wet or dry processing photographic material 1 by lowering the container 8 when required. The photographic material 1 is placed as an endless loop round two drums 3, 9. The drums 3, 9 are mounted with their shafts in a support 10 whose length is adjustable for stretching photographic materials 1 of different lengths over the drums; the lengths A, B, C . . . of the various sections of the processing bands 2 must then, of course be varied accordingly.

In a method illustrated in FIG. 4 which is designed for short photographic processes or for repeated use of a processing band 2, the band 2 is placed as endless loop over two rollers 10, 11. The length of the loop of band 2 is equal to the sum of the sections A, B, C used for the various steps of the process. The drum 3 with the photographic material 1 on it is pressed against the processing band 2 and revolves with the band 2 when one of the rollers 10, 11 is driven. Alternatively, the drum 3 may be driven, in which case it drives the processing band by contact. The liquid is supplied from a moistening device 5 before the band 2 is brought into contact with the photographic material 1.

One example of a practical application of this method is the processing of photographic paper which has been image exposed in a black-and-white process. The photographic paper 1 is stretched on the drum 3 and the drum 3 is rotated. A section A of the processing band 2, carrying a developer chemical with which it was moistened by the device 5, is the first to be brought into contact with the paper 1 which is thus developed. The second section B contains a short stop chemical and the third section a fixative. If, in the simplest case, the processing band comprises only three sections, then the paper carrying the image must subsequently be washed, The band may, however, also contain additional sections for washing the paper image. The drum 3 is removed after three or more revolutions, and another exposed photographic paper is inserted and processed.

The moistening devices 5 illustrated in FIG. 1 and FIG. 3 in which the aqueous liquid is brought from a container 12 by a sponge 13 or the like to be applied to the processing band, may be replaced by an applicator roller adapted to be swung into and out of position. Alternatively, the the moistening device may be fixed in position and the band 2 pressed against it to be moistened.

FIG. 5 is a sectional view through a drum 3 provided to hold the photographic material 1. The drum 3 has a circumferential recess 14 in which the photographic material 1 is inserted and attached to the circumference. The material 1 may be attached in known manner by means of clamps or hooks or it may be pushed into a groove on both sides, but whatever method is used, the photographic material must not become detached. The drum 3 may also be covered with a plurality of short pieces of photographic material 1 if suitable means are provided for fixing the material. The processing band 2 placed over the photographic material 1 is supported between lateral recesses 15.

The processing band 2 is shown as a two-layered band in FIG. 5, comprising a support band 16 and an absorbent material 17 containing the chemicals.

FIG. 6 shows a drum 3 suitable for a method used for processing either long strips of photographic material 1 or wide sheets of phhotographic paper. The drum 3 has considerable width so that a long photographic strip 1 may be wound in several spirals round the drum. A processing strip 2 of corresponding width is then used.

The processing strip 2 is indicated schematically in FIG. 7. It comprises a leader tape A and follower tape Z which may be made of simple waterproof paper, a plastics material, a metal foil or the like. The various sections B, C, D, E, F . . . for the different steps of the process are arranged between the leader tape A and the follower tape Z. The length of the said sections is equal to or a multiple of the circumference of the drum 3 or of the endless path in FIG. 3. These sections B, C, D . . . may contain processing chemicals for development, colour development, short stopping, bleaching, fixing, etc. or chemicals for neutralising the processing chemicals.

To prepare these sections B, C, D . . ., absorbent materials are supplied with concentrated chemical solutions, as described above, by immersion, spraying, coating or casting and are then dried and cut up into pieces of the required length and width. The sections corresponding to the various processing steps are arranged one behind the other and joined together by glueing, sewing, welding or the like.

Between the sections containing chemicals or before or after these sections, other sections equally necessary for the process are added or inserted, for example sections of simple absorbent material to absorb moisture or chemicals or absorbent sections designed to suck in liquid and wet the surface of the photographic material or absorbent sections for drying the photographic material after processing. If a chemical applied to the photographic material is required to act on it for a considerable length of time or if the photographic material is required to be subjected to prolonged washing by one of the methods illustrated in FIGS. 2 and 3, a section E is inserted in the processing band 2. This section E has only two strips 18 along the edges so that the image area of the photographic material is left open. The middle portion of the processing band may be punched out in this area or the band may be held together by two strips 18 or other connecting means.

The processing band 2 is at least as wide as the photographic material 1. To switch the moistening device 5 for the processing band 2 into and out of the operative position, the band 2 is provided with notches or perforations or, as illustrated in FIG. 7, a punched out area 8 in which a device such as a mechanical pawl, for example, engages to move the moistening device 5. The punched out areas 8 in FIG. 7, for example, ensure that the leader tape A and follower tape Z do not get moistened. One could equally well make those parts of the processing band 2 which are not to be moistened somewhat wider so that they cause the moistening device 5 to deflect.

FIG. 8 shows a section through the processing band 2 taken transversely to its direction of travel. The processing band 2 may be made of a single strip of material 17, for example a waterproof blotting paper or other absorbent material 17. The absorbent material 17 may be applied to a waterproof or water-impermeable support band 16. FIG. 8 shows a further development of the processing band 2 which comprises not only a support band 16 and absorbent material 17 but also a protective layer 19 to cover the absorbent material 17. The protective layer 19 may be water-soluble so that it dissolves when wetted with water and thus releases the chemicals for processing the photographic material.

Alternatively, the protective layer 19 may consist of an aluminium foil or a plastics foil which may be stripped off on its entry into a processing apparatus to release the chemicals. The advantage of this is that the chemicals may already be in the form of a solution in the absorbent material so that neither a moistening device 5 nor a container 8 for water will be required.

FIG. 9 shows a processing band 2 consisting of two layers 17, 17' of absorbent material. Such a double band is advantageous for applying exceptionally large quantities of chemicals or when using two chemicals which react with each other in the dry state. The absorbent material 17 contains one of the two chemicals in the dry form and the absorbent material 17' the other chemical, also in the dry form. When the double band is moistened, the two chemicals mix so that they may process the photographic material.

EXAMPLE

A strip measuring 3.5 cm×40 cm is cut out of commercial black-and-white enlargement paper having a normal gradation. The strip is exposed through a step wedge and stretched over a drum 3 shown in FIG. 1.

An absorbent non-woven web of fibres (Vileda) was also cut up into strips measuring 3.5 cm×40 cm. Each of three of these strips is impregnated with one of the following solutions:

Strip 1: 80 g of $K_2CO_3$ dissolved in 500 ml of $H_2O$ (100 g of $K_2CO_3/m^2$)

Strip 2: 25 g of hydroquinone and 1 g of phenidone dissolved in 500 ml of ethanol. The strip was dried and impregnated with a second solution of 80 g of $NA_2SO_3$ sicc. and 4 g of KBr in 500 ml of $H_2O$. The strip then contained 39 g of hydroquinone, 1.6 g of phenidone, 95 g of $Na_2SO_3$ and 5 g of KBr per square meter.

Strip 3: 360 g of $Na_2S_2O_3.5\ H_2O$ in 500 ml of $H_2O$ (250 g of $Na_2S_2O_3.5\ H_2O/m^2$).

The dried strips, 1, 2, 3 were glued in that order to a leader tape, and a strip for washing and another strip for drying were attached as follower tape.

The processing band 2 was moved past the moistening device 5 and round the photographic material 1 and rolled up. The processing band moved at the speed of 80 cm/min. The moistening device was moved away before the last section provided for drying was reached.

A fixed, almost dry negative of the grey step wedge with very good maximum densitites and good whites was obtained.

We claim:

1. A method of processing a photographic material in the form of a sheet which has been image exposed, in which the photographic material is brought into surface contact with the support impregnated with the required processing chemicals in the presence of the required quantity of water, characterised in that the photographic material which has been image exposed is moved repeatedly along a closed path having radii of curvature perpendicular to the active surface of the photographic material, the photographic material is brought into surface contact with a processing band over a specified portion of the closed path in the presence of the required quantity of water, and arranged one behind the other in the longitudinal direction, the processing band has at least two sections with different processing functions or processing chemicals, so that in the course of processing, every portion of the photographic material is successively brought into contact with at least two sections having different processing functions.

2. A method according to claim 1, characterised in that the material which has been image exposed is moved at the same speed as the processing band, and the length of the sections of the processing band is in each case equal to or an integral multiple of the length of the closed path of the photographic material.

3. A method according to claim 1, characterised in that the processing band is moved at a lower speed than the material which has been image exposed, and the length of each section of the processing band is chosen so that the treatment time is equal to or an integral multiple of the time taken for the photographic material to move round the closed path.

4. A method according to claim 1, characterised in that the processing band is moved intermittently and each section of the processing band remains in contact with the material which has been image exposed until the said material has moved once or an integral multiple of times round a closed path.

5. A method according to claim 1, characterised in that at least one section of the processing band contains chemicals for the development of silver halides which have been image exposed.

6. A method according to claim 5, characterised in that at least one section of the processing band contains a colour developer substance.

7. A method according to claim 5, characterised in that at least one further section of the processing band contains a silver bleaching agent.

8. A method according to claim 5, characterised in that at least one further section of the processing band contains a slver halide solvent.

9. A method according to claim 1, characterised in that the photographic material which has been image exposed is stretched at least once round a drum which is adapted to be driven, and the sections of the processing band are carried over part of the circumference of the drum and brought into contact with the photographic material.

10. A method according to claim 1, characterised in that the photographic material which has been image exposed is carried in the form of an endless loop over at least two drums, the processing band with its sections is carried in contact with the photographic material over at least one drum, and the photographic material is carried over at least one drum in its passage through an aqueous liquid.

11. A method according to claim 1, characterised in that the processing band is carried from a take-off device to be moved past a moistening device and over the zone of contact with the exposed photographic material to a winding on device.

12. A method according to claim 1, characterised in that the processing band having at least two sections is moved along a closed path and the photographic material which has been image exposed is moved along a closed path on a drum or in a loop so that the whole surface of the photographic material makes contact with each section of the processing band.

13. A processing band for processing photographic materials in the form of a sheet which has been image exposed, by which the photographic material is brought into surface contact with the support, impregnated with the required processing chemicals in the presence of the required quantity of water, characterized in that the processing band is provided with at least two sections containing different processing chemicals and are arranged one behind the other in longitudinal direction, these sections are of equal lengths or multiples of the length if the respective processing chemical used is applied successively and the length of the longitudinal processing sections is equal to or a multiple of the sheet length to be processed.

14. A process band for processing photographic materials according to claim 13, characterized in that the processing band is provifed with additional sections having further processing functions which additional sections are arranged before, behind or between the sections containing the processing chemicals and the length of the additional sections is dependent on the sheet length to be processed.

15. A processing band for processing photographic material according to claim 14, characterized in that sections are provided in the processing band which absorb an aqueous liquid and give it up to the photographic sheet so that the photographic material is moistened with the liquid.

16. A processing band according to claim 14, characterised in that the processing band has sections which absorb, neutralise or bind the processing chemicals or chemical reaction products of processing.

17. A processing band according to claim 14, characterised in that the processing band has sections which absorb liquid and dry the photographic material.

18. A processing band according to claims 13 or 14, characterised in that the processing band consists of a plurality of layers, at least one of which layers is impregnated with processing chemicals or has a processing function while an upper and a lower layer cover the processing chemicals to protect them, and one of the last mentioned layers is soluble in the aqueous liquid.

19. A processing band according to claims 13 or 14, characterised in that the processing band is attached to a support layer and equipped with processing chemicals in the moist state, and the moist chemicals are enclosed by a moistureproof foil adapted to be stripped off inside the processing apparatus.

20. A processing band according to claims 13 or 14, characterised in that in one section of the band, at least two dry layers containing different chemicals are arranged one above the other, which layers do not react with each other until they come under the influence of an aqueous liquid, when they fulfil their processing function.

21. A processing band according to claim 14, characterised in that the processing band comprises at least one section in which the image area is cut out for washing of the photographic material in a bath of water or for interrupting the process.

* * * * *